US006579578B1

(12) United States Patent
Lai

(10) Patent No.: US 6,579,578 B1
(45) Date of Patent: Jun. 17, 2003

(54) FOLDABLE ORNAMENT FRAME STRUCTURE

(76) Inventor: Chi Shih Lai, 1F, No. 91, Lane 259, Szu Wei Rd, Panchiao, Taipei Hsien (TW)

( * ) Notice: Subject to any disclaimer, the term of this patent is extended or adjusted under 35 U.S.C. 154(b) by 0 days.

(21) Appl. No.: 10/217,125

(22) Filed: Aug. 13, 2002

(51) Int. Cl.[7] ..... G09F 19/00

(52) U.S. Cl. ..... 428/12; 428/7; 428/8; 428/9; 428/11; 428/18; 428/20; 428/27; 248/175; 362/252; 362/249

(58) Field of Search ..... 428/7–9, 12, 11, 428/18, 20, 27; 248/175; 362/252, 806

(56) References Cited

U.S. PATENT DOCUMENTS 4,596,726 A * 6/1986 Wrzalinski ..... 428/11
5,629,057 A * 5/1997 Wang et al. ..... 428/9
6,135,617 A * 10/2000 Lai ..... 362/249
6,206,561 B1 * 3/2001 Hefti ..... 366/129

* cited by examiner

*Primary Examiner*—Deborah Jones
*Assistant Examiner*—Arden Sperty
(74) *Attorney, Agent, or Firm*—Browdy and Neimark, P.L.L.C.

(57) ABSTRACT

A foldable ornament frame structure of the invention includes a first movable part, a second movable part, and a plurality of support rods. The first and second movable parts are respectively mounted at a top and a bottom of the ornament frame structure. The support rods connect the first movable part to the second movable part around the ornament frame to outline the ornamental shape of the ornament frame. The first and second movable parts respectively include a plurality of strips that are superposed and cross over one another at approximately respective central portions thereof. A hinge passes through the central portions to pivotally connect the strips together, the support rods connecting the strips of the first and second movable parts to outline the ornamental shape of the ornament frame.

11 Claims, 6 Drawing Sheets

FOLDABLE ORNAMENT FRAME STRUCTURE

BACKGROUND OF THE INVENTION

1. Field of the Invention

The invention relates to a foldable ornament frame structure and, more particularly, to a foldable ornament frame structure that, after being folded has a reduced occupation space.

2. Description of the Related Art

To create a pleasant atmosphere in celebration days, ornaments are often used to symbolize the specific celebration.

As shown in FIG. 1, the structure of a conventional ornament frame 1*a* comprises a plurality of support rods 10*a* that are bent to form planar patterns of approximately the same size. The support rods 10*a* are superposed together in a manner to cross over each other at an upper portion 11*a* and lower portion 12*a,* both upper and lower portions 11*a,* 12*a* defining a central axis of the ornament frame 1*a*. The support rods 10*a* are fixedly attached to one another at the upper and lower portions 11*a,* 12*a,* which achieves the ornament frame 1*a*.

Unfortunately, when the moments of celebration are over, the placement of the ornament frame 1*a* needs a non-negligible occupation space. The ornament frame 1*a* has a skeleton that is principally composed of the support rods 10*a* that, when stored, are not very resistant to the weight of other products stacked thereon and may be deformed. Furthermore, vis-à-vis the manufacturer or the seller, this conventional ornament frame 1*a* is cumbersome to store because it cannot be folded and requires a substantial occupation space. Because the ornament frame 1*a* needs a substantial occupation, its storage and carrying therefore have significant inconveniences that need to be improved.

SUMMARY OF THE INVENTION

It is therefore a principal object of the invention to provide a foldable ornament frame structure that, after being folded, has a substantially reduced occupation space, which therefore provides an easy use of the ornament frame for carrying and sales.

To accomplish the above and other objectives, a foldable ornament frame structure of the invention comprises a first movable part, a second movable part, and a plurality of support rods. The first and second movable parts are respectively mounted at a top and a bottom of the ornament frame structure. The support rods connect the first movable part to the second movable part around the ornament frame to outline the ornamental shape of the ornament frame. The first and second movable parts respectively include a plurality of strips that are superposed and cross over one another at approximately respective central portions thereof. A hinge passes through the central portions to pivotally connect the strips together, the support rods connecting the strips of the first and second movable parts to outline the ornamental shape of the ornament frame structure.

To provide a further understanding of the invention, the following detailed description illustrates embodiments and examples of the invention, this detailed description being provided only for illustration of the invention.

BRIEF DESCRIPTION OF THE DRAWINGS

The drawings included herein provide a further understanding of the invention. A brief introduction of the drawings is as follows:

FIG. 6, zone A is a locally enlarged view showing the hanging elements of the other embodiment of the invention.

DETAILED DESCRIPTION OF THE EMBODIMENTS

Figure 1:
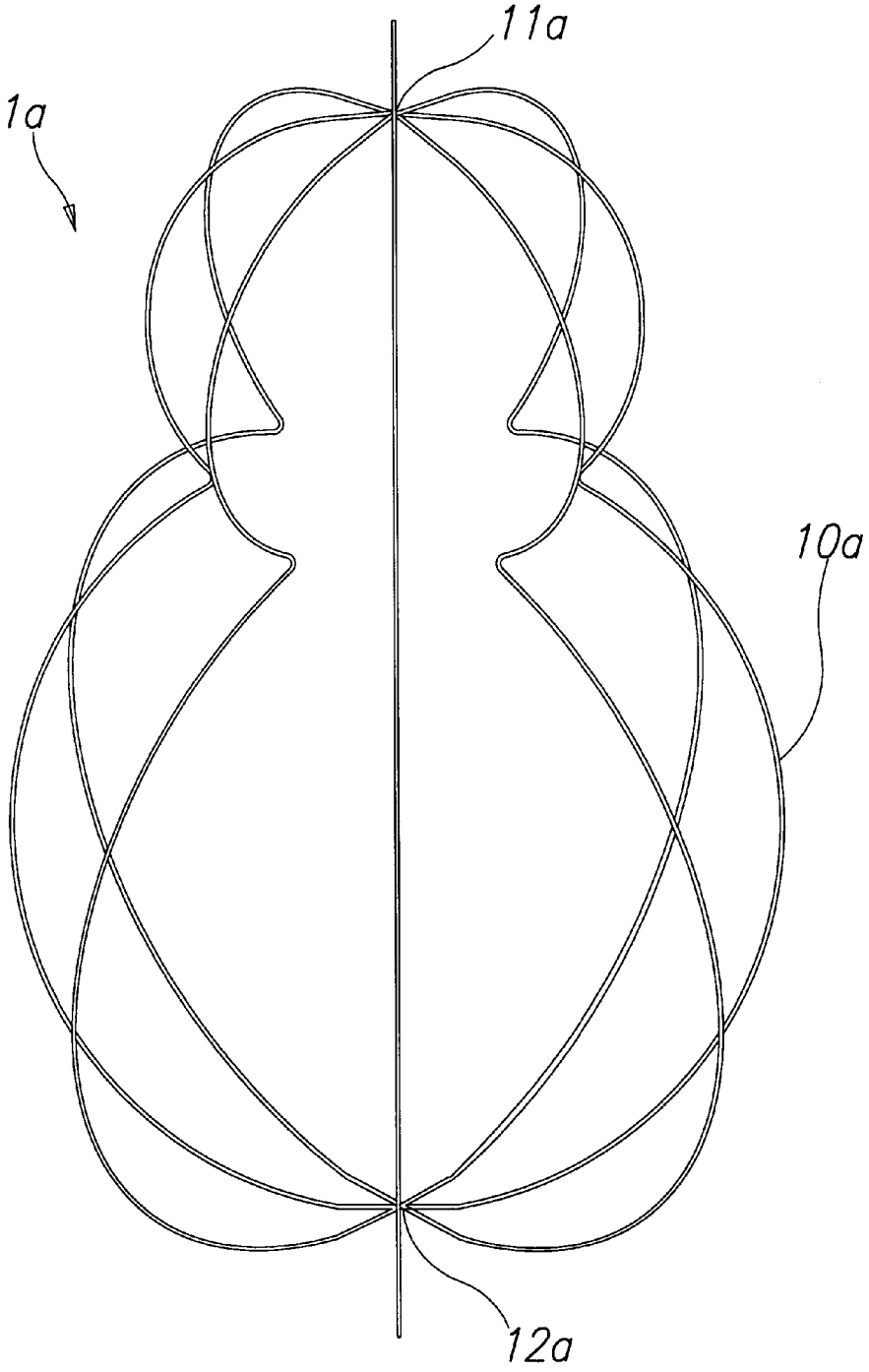
FIG. 1 PRIOR ART
FIG. 1 is a perspective view schematically illustrating an ornament frame known in the prior art.

Wherever possible in the following description, like reference numerals will refer to like elements and parts unless otherwise illustrated.

Reference now is made to FIG. 2 through FIG. 5 to describe a foldable ornament frame structure according to an embodiment of the invention. As illustrated, an ornament frame 1 of the invention comprises a first movable part 10, a second movable part 11, and a plurality of support rods 12. This embodiment refers to the nonrestrictive example of a snowman-shaped ornament, but it is understood that it may include various shapes such as pumpkin, Christmas tree, elf, etc.

The first movable part 10 includes a plurality of strips 13 that are superposed in crossing manner over one another at approximately their respective central portion. A hinge 14 is passed through these central portions to pivotally connect the strips 13 together. The strips 13 thereby can be rotated relative to one another around the hinge 14. The structure of the second movable part 11 is similar to that of the first movable part 10. The first movable part 10 is arranged at a top of the ornament frame 1 and the second movable part 11 is arranged at a bottom of the ornament frame 1 in a manner that their respective hinges 14 are approximately aligned with each other on a central axis of the ornament frame 1.

The support rods 12 are bent and respectively connect the first movable part 10 to the second movable part 11 around the ornament frame 1 to outline its ornamental shape. The connection of the support rods 12 to the first and second movable part 10, 11 is more particularly achieved through connecting their respective strips 13.

Figure 2:
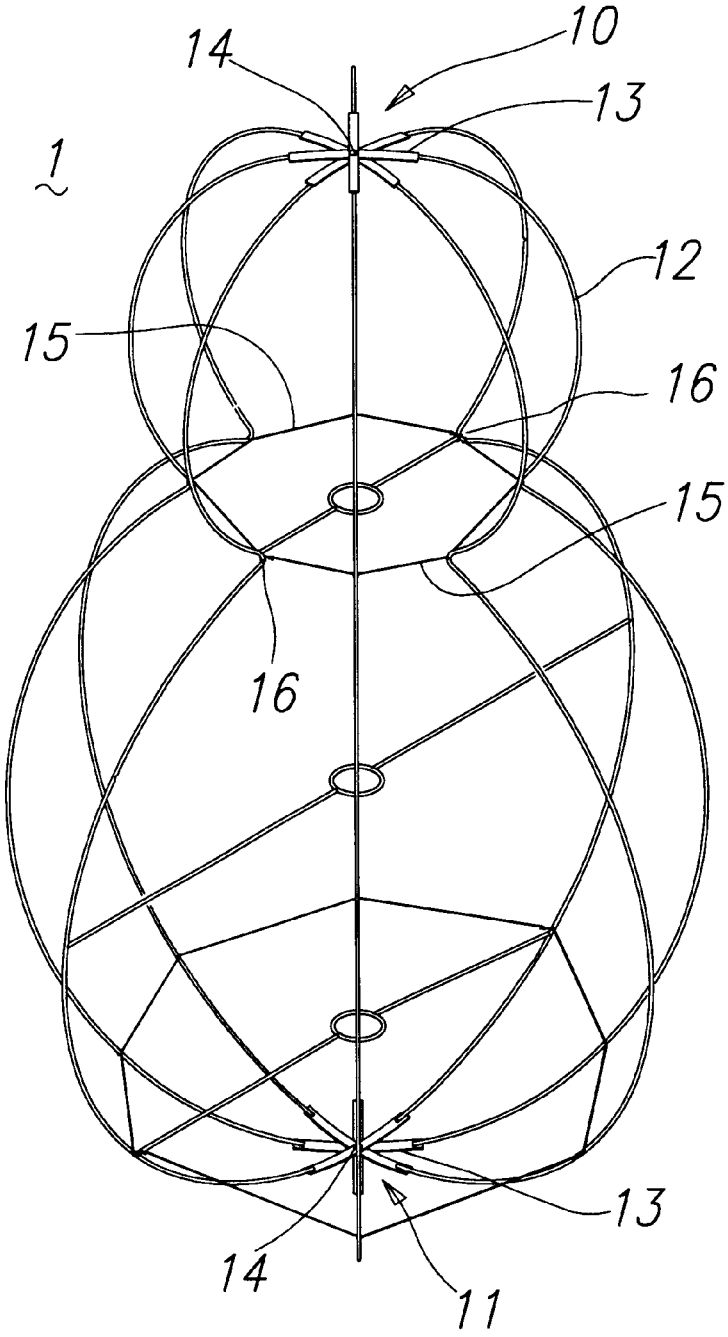
FIG. 2 is a perspective view schematically illustrating a foldable ornament frame according to an embodiment of the invention, the ornament frame being shown unfolded.
Figure 3:
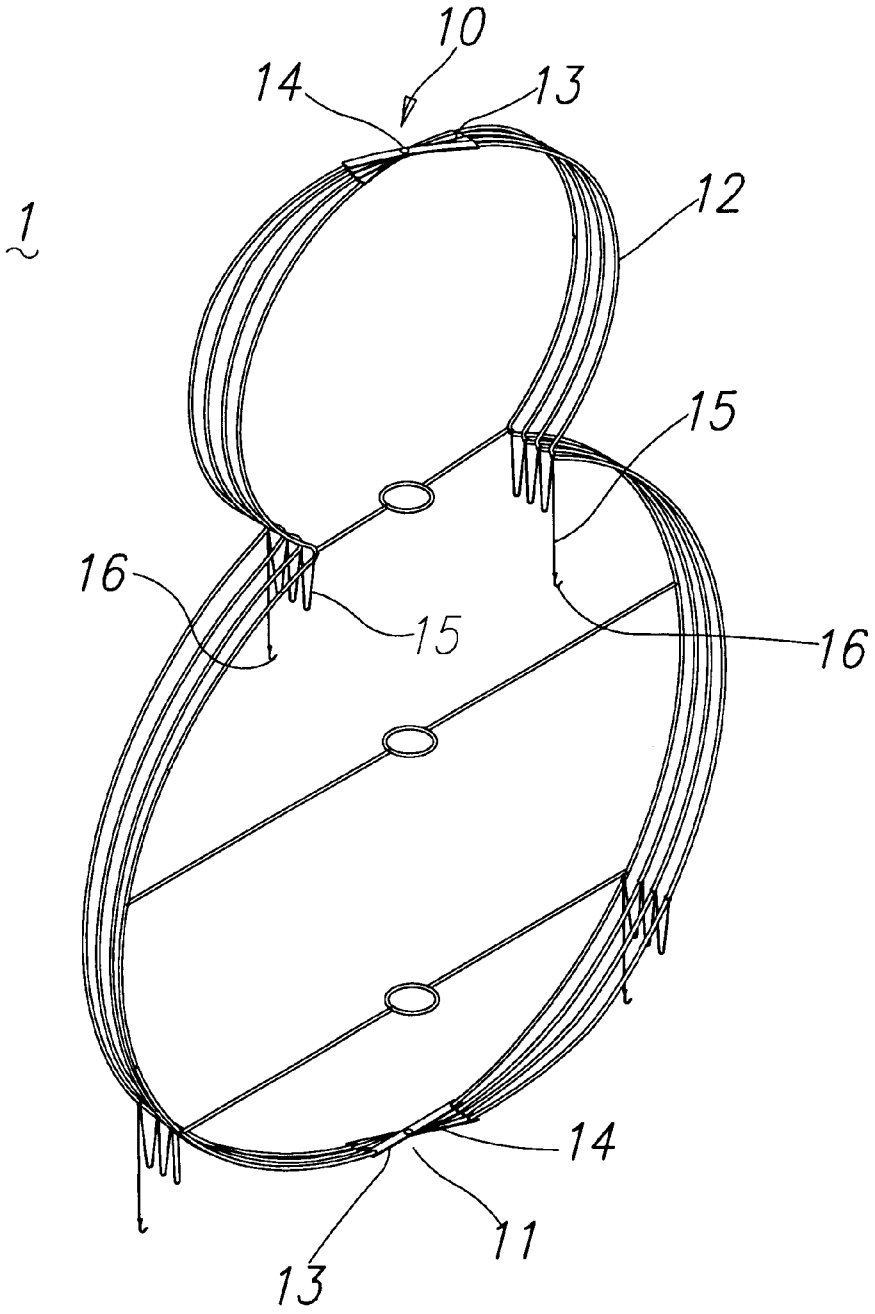
FIG. 3 is a perspective view illustrating the foldable ornament frame of the invention in a folded configuration.
Figure 5:
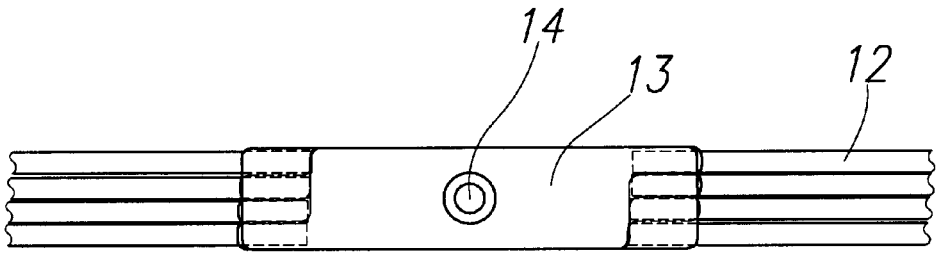
FIG. 5 is a planar view of the movable part being folded.
Figure 4:
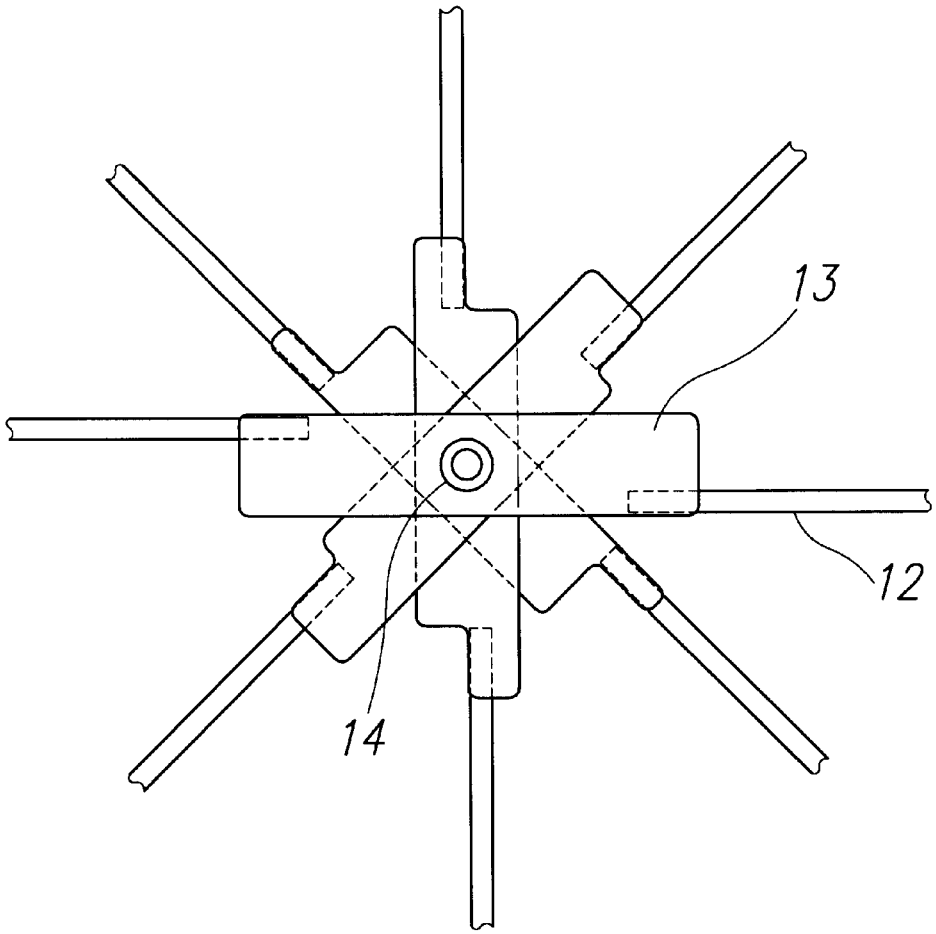
FIG. 4 is a planar view of a movable part of the foldable ornament frame according to an embodiment of the invention, the movable part being shown unfolded.

The ornament frame 1 further includes at least two flexible wires 15 that fasten the support rods 12 to one another. The flexible wires 15 respectively have an end provided with a hook 16 that is capable of hooking the support rods 12 so that when the ornament frame 1 is unfolded (as shown in FIG. 2), the flexible wires 15 enable to hold the support rods 12 spread out. Thereby is achieved the foldable ornament frame structure of the invention.

Figure 6:
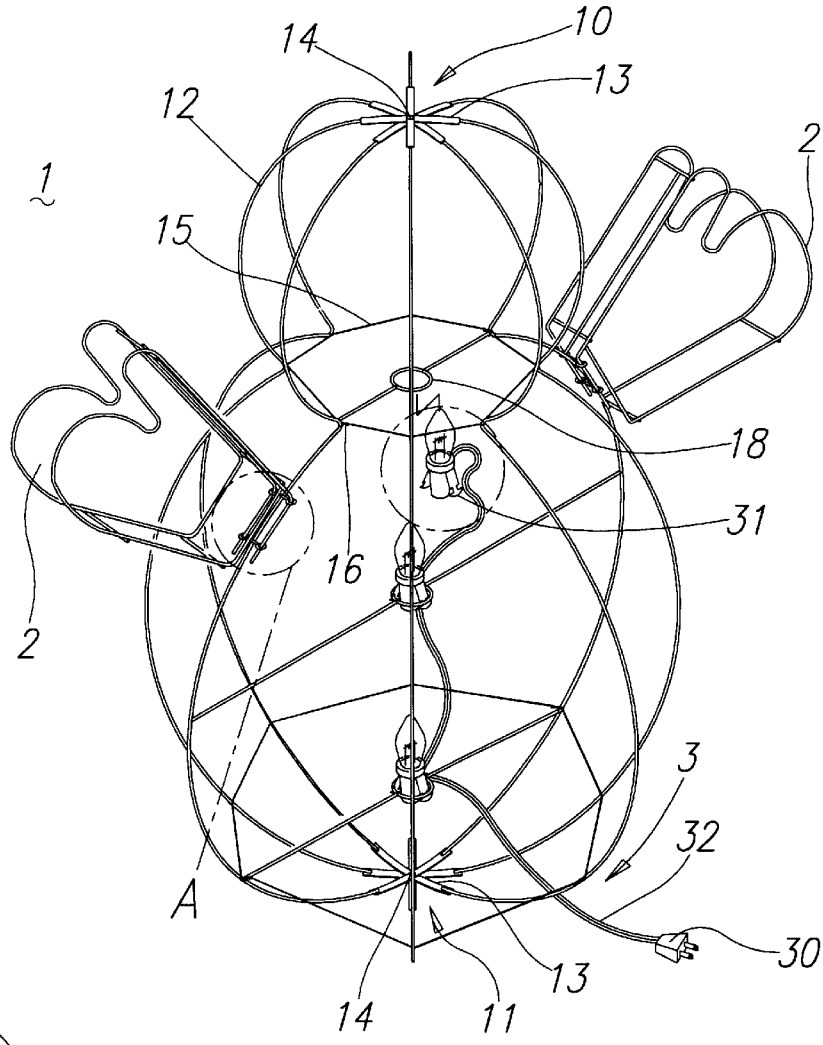
FIG. 6 is a perspective view of a foldable ornament frame according to another embodiment of the invention.
Figure 6A:
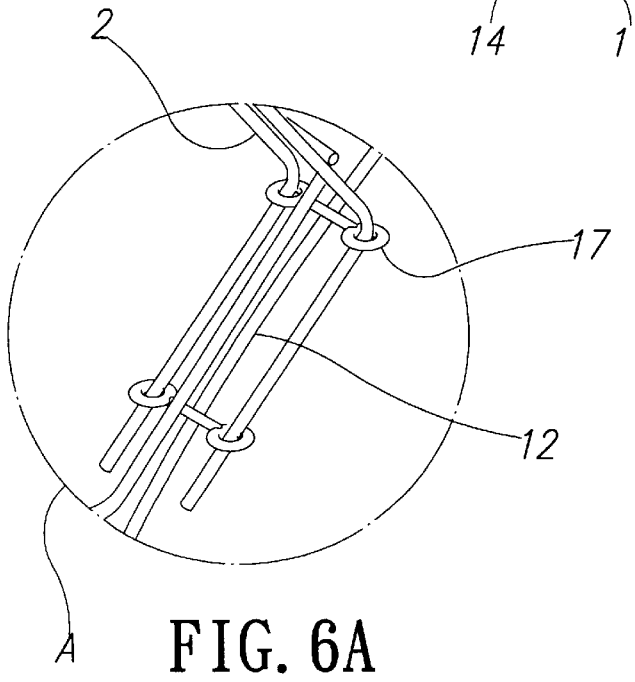

As shown in FIG. 6, to complete the external aspect of a snowman ornament, hanging elements 17 may be further mounted on the support rods 12 (as shown in zone A of FIG. 6) according to another embodiment of the invention. The hanging elements 17 thereby enable to add two arm ornament frames 2 to the snowman-shaped ornament frame 1. Being slipped on the hanging elements 17, the arm ornament frames 2 can be therefore easily dismantled.

Within the ornament frame 1 is further installed a light-emitting device 3 that comprises at least an electrical plug 30, at least a light-emitting element 31 and a power cable 32 connecting the electrical plug 30 to the light-emitting element 31. Within the ornament frame 1 is further arranged a supporting portion 18 to support the light-emitting element 31, the supporting portion 18 being connected to two opposite support rods 12.

Figure 7:
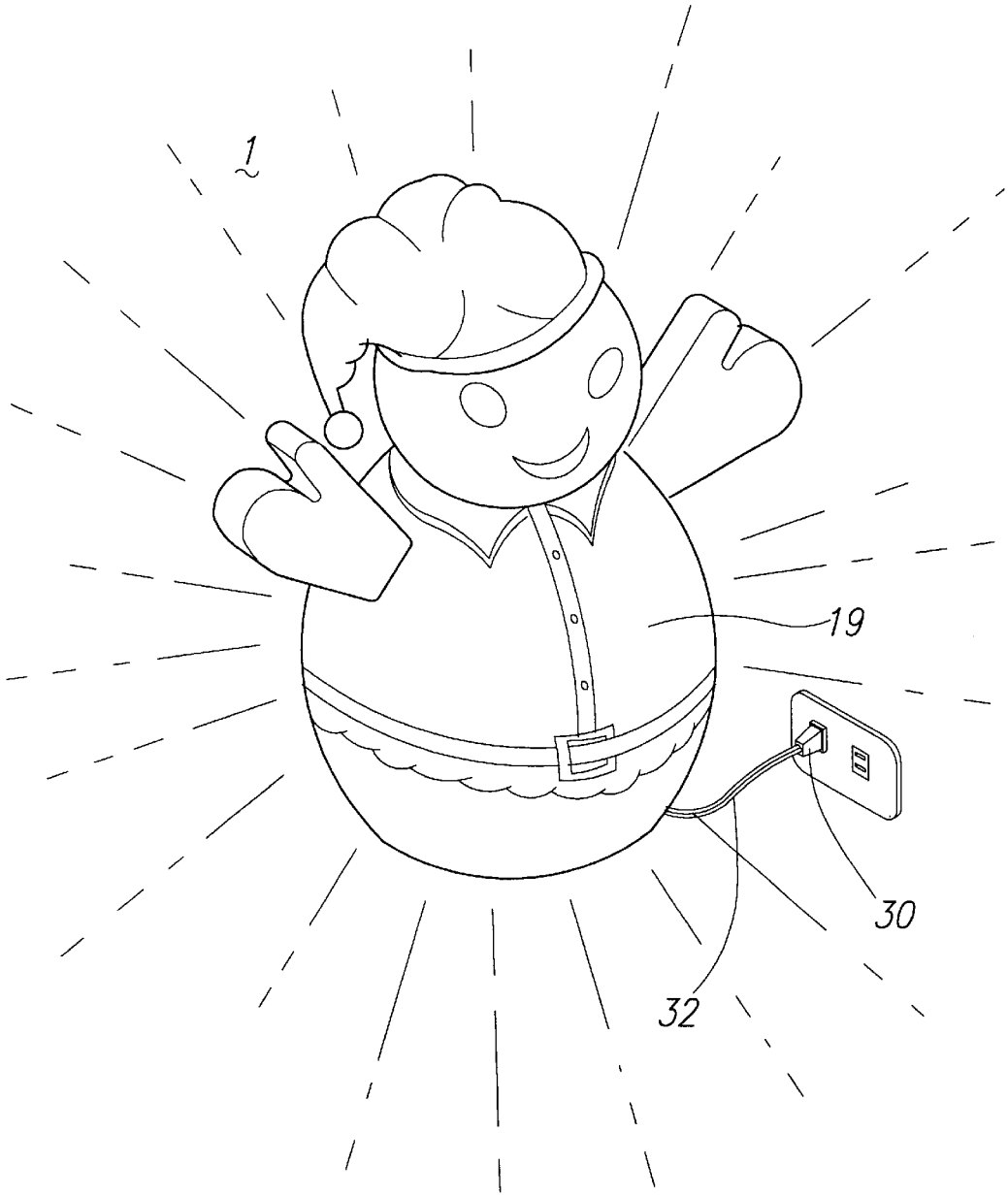
FIG. 7 is a perspective view schematically illustrating an implementation of the ornament frame according to the other embodiment of the invention.

Lastly, the snowman ornament frame 1 is draped with a decorative layer 19. Via the light illuminated from the light-emitting element 31, a pleasant decorative effect can be thereby achieved (as shown in FIG. 7). Optionally, light-emitting elements may be also arranged on the ornament frame 1 (not shown) such as, for example, Christmas lamp bulbs.

As described above, the invention therefore provides an ornament frame structure that is foldable. In one embodiment, the ornament frame comprises a first movable parts 10 and second 11 that are provided with hinges 14 and support rods 12 pivotally connected to the hinges 14 via strips 13. The support rods 12 can be thereby conveniently retracted in stack with a reduced occupation space, which provides easy use for carrying, sales, etc. The ornament frame of the invention further allows the easy mount and dismantle of additional hanging elements 17 to further add other ornament frames for improving the aesthetic aspect of the ornament.

Those skilled in the art will readily appreciate that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A foldable ornament frame structure, comprising:

a first movable part, placed at a top of the ornament frame structure;

a second movable part, placed at a bottom of the ornament frame structure; and a plurality of support rods, connecting the first movable part to the second movable part around the ornament frame structure to outline the ornamental shape of the ornament frame structure;

wherein the first and second movable parts respectively comprise a plurality of strips that are superposed in crossing manner over one another at respective central portions thereof, a hinge passing through the central portions to pivotally connect the strips together, the support rods connecting the strips of the first and second movable parts.

2. The structure of claim 1, wherein the ornamental shape of the ornament frame structure is a snowman.

3. The structure of claim 1, wherein the ornamental shape of the ornament frame structure is a pumpkin.

4. The structure of claim 1, wherein the ornamental shape of the ornament frame structure is a Christmas tree.

5. The structure of claim 1, wherein the ornamental shape of the ornament frame structure is an elf.

6. The structure of claim 1, wherein a light-emitting element is mounted on the ornament frame structure.

7. The structure of claim 1, wherein the ornament frame structure is draped with a decorative layer.

8. The structure of claim 1, wherein the support rods are provided with at least a hanging element.

9. The structure of claim 1, further comprising at least two flexible wires fastening the support rods with one another.

10. The structure of claim 9, wherein a plurality of hooks are respectively disposed on each end of the flexible wires.

11. The structure of claim 1, further comprising a light-emitting device being disposed in the foldable ornament frame structure, the light-emitting device having at least one electrical plug, at least one light-emitting element, and a power cable electrically connecting the light-emitting element to the electrical plug, a supporting portion being further connected to two opposite support rods to provide support to the light-emitting element.

* * * * *